United States Patent [19]

Baetz et al.

[11] Patent Number: 4,545,421

[45] Date of Patent: Oct. 8, 1985

[54] NONSKID BOX STUDS

[75] Inventors: Wolfgang Baetz, Grossalmerod; Albrecht Graefer, Kaufungen; Edgar Löw, Schmitten, all of Fed. Rep. of Germany

[73] Assignee: Karl Schmidt Fabrik fur Giessereibedarf GmbH & Co., Schmitten, Fed. Rep. of Germany

[21] Appl. No.: 678,671

[22] Filed: Dec. 5, 1984

[30] Foreign Application Priority Data

Dec. 8, 1983 [DE] Fed. Rep. of Germany ... 8335255[U]

[51] Int. Cl.[4] ..... B22C 21/14; B29C 9/10

[52] U.S. Cl. ..... 164/397; 164/398; 249/62

[58] Field of Search ..... 249/61, 62, 176, 177, 249/205; 164/397, 398, 399, 400

[56] References Cited

U.S. PATENT DOCUMENTS

| | | | |
|---|---|---|---|
| 702,620 | 6/1902 | Bole | 164/398 |
| 2,013,746 | 9/1935 | Ditty | 164/398 |
| 2,049,886 | 8/1936 | Angell et al. | 164/398 |
| 3,288,423 | 11/1966 | Linden | 249/176 X |

FOREIGN PATENT DOCUMENTS

| | | | |
|---|---|---|---|
| 2258831 | 5/1974 | Fed. Rep. of Germany | 164/397 |

*Primary Examiner*—J. Howard Flint, Jr.

*Attorney, Agent, or Firm*—Berman, Aisenberg & Platt

[57] ABSTRACT

A plurality of supporting elements for providing a separation between adjacent casting molds are interconnected by a web or band. The interconnecting element allows the supporting elements to be easily placed on a mold surface, and requires securing only selected ones of the supporting elements to the mold surface. The remainder of the supporting elements are held in place by the action of the interconnecting element.

10 Claims, 7 Drawing Figures

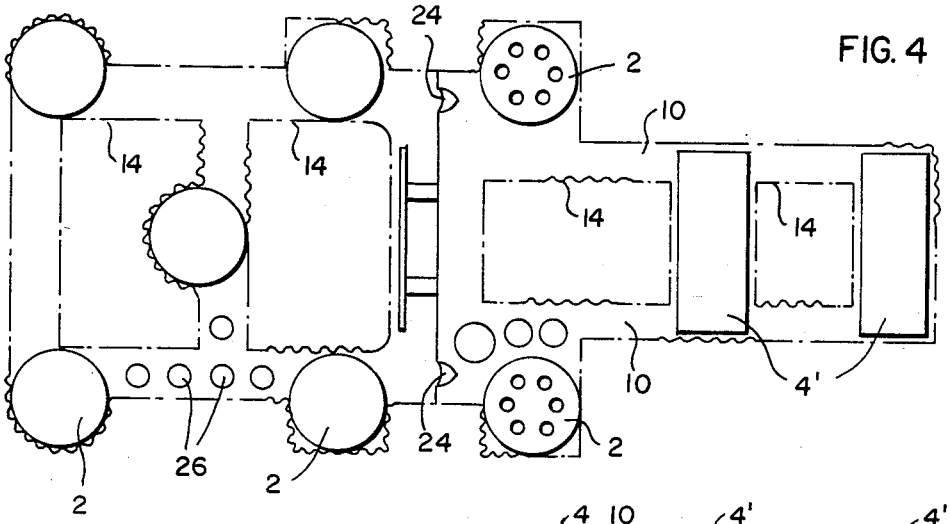
FIG. 4
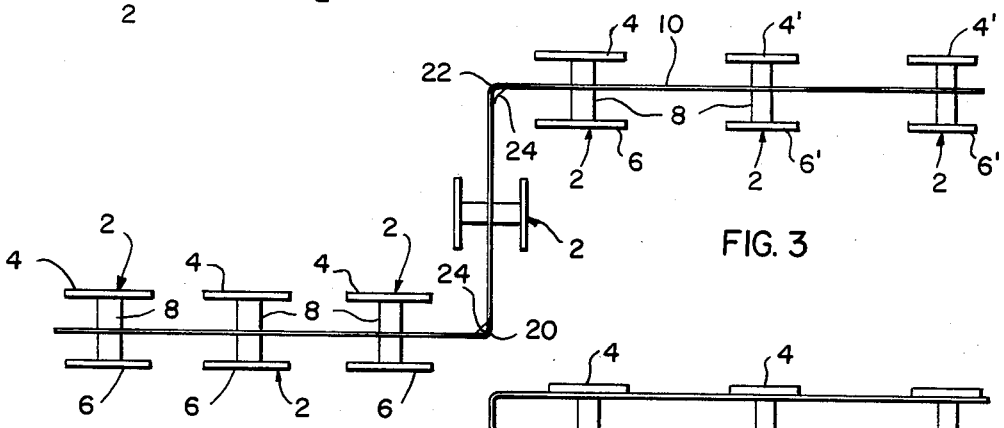
FIG. 3
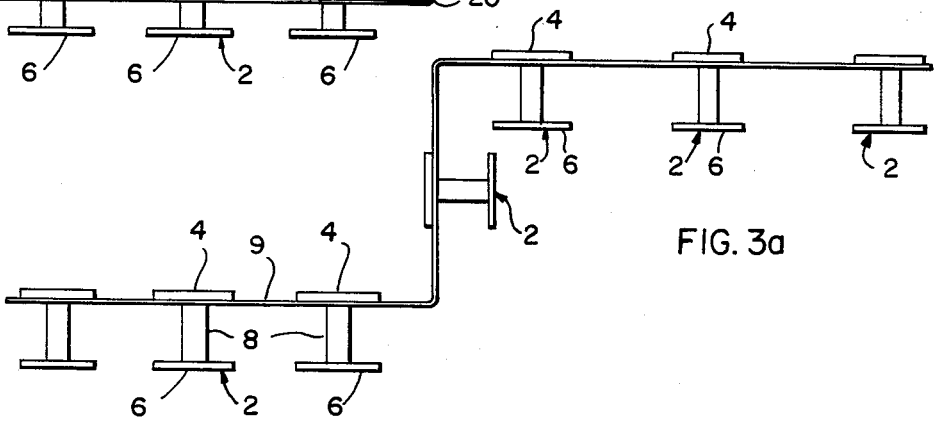
FIG. 3a
FIG. 2
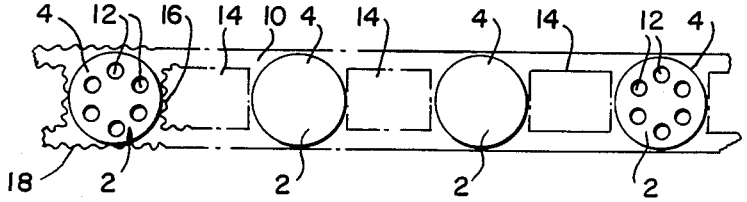
FIG. 1
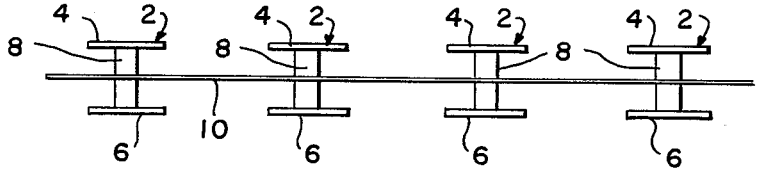

NONSKID BOX STUDS

TECHNICAL FIELD

This invention relates to the art of casting, and in particular relates to the art of casting structures having supporting elements which are fused into a molded product.

BACKGROUND ART

It is known in the art of casting to provide a supporting element, a "box stud", having upper and lower support plates connected by a bar-like separation element for being placed between form surfaces. Published German Patent Application No. 2,258,831 shows such a supporting element.

A prior-art supporting element is attached to the core surface by using nails which pass through perforations in upper or lower supporting plates. These nails are driven into the molding sand of the core and thus require a significant amount of labor. Furthermore, in practice it has been found that automatic nailing machines are not useful in this operation and that the nailing frequently damages the molding sand.

It is also known, for example, from published German Patent Application No. 2,923,702 that the supporting element can be glued to the front surface of a core. This type of supporting element suffers from the disadvantage that it cannot be placed on the core surface by an automatic setting machine because the elements become glued together in the feeder box of the automatic setting machine. Furthermore, coating with glue requires an additional step which adds expense to the operation.

It is also known to provide support plates with front faces having a plurality of concentric ribs of semi-circular cross section. The ribs are designed to extend into the molding sand to thereby increase the resistance to moving the supporting elements with respect to the core surface. This has not been successful, however, for several reasons. The supporting elements are small, light objects that do not effectively penetrate into the molding sand which has typically been soaked with furan resin. The distance between the outer extent of the ribs and the form surface is so small that liquid metal cannot flow between a support plate and the surface of the mole sand, thus producing an unsightly depression in the surface of the finished casting. The provision of the ribs also results in additional cost.

SUMMARY OF THE INVENTION

In accordance with the invention, a plurality of supporting elements are secured to each other by an interconnecting element. The supporting element includes two support plates and a separation element. In one embodiment, the interconnecting element is attached to the separation element which extends between upper and lower support plates. In a second embodiment, the interconnecting element is attached to an inner surface of one of the first and second support plates. The supporting elements and the interconnecting element are made of fusible material and are welded into the final casting.

The interconnecting element fixes the distances between adjacent supporting elements and preferably follows the contour of the core surfaces. The force required to support the casting plates is divided among the various supporting elements. Furthermore, the interconnecting element provides for positive fixation of the supporting elements to an uneven core surface and facilitates the correct positioning of the supporting elements.

In one embodiment, the interconnecting element comprises a closed loop. In a second embodiment, the interconnecting element is a strip having a plurality of openings with serrated edges. In other embodiments, the interconnecting element is a wire and a wire mesh.

An object of this invention is to provide supporting elements for spacing casting cores wherein the supporting elements are interconnected.

Another object of this invention is to provide interconnected spacing elements wherein the interconnecting element is bent to follow the contour of a casting core.

BRIEF DESCRIPTION OF THE DRAWINGS

FIG. 1 is an elevation view of a plurality of supporting elements in accordance with the invention.

FIG. 2 is top view of the structure shown in FIG. 1.

FIG. 3 is elevation of a plurality of supporting elements wherein the interconnecting element is bent.

FIG. 3*a* is a modified form of the invention shown in FIG. 3.

FIG. 4 is a plan view of the invention as shown in FIG. 3.

DETAILED DESCRIPTION OF INVENTION

Figure 5:
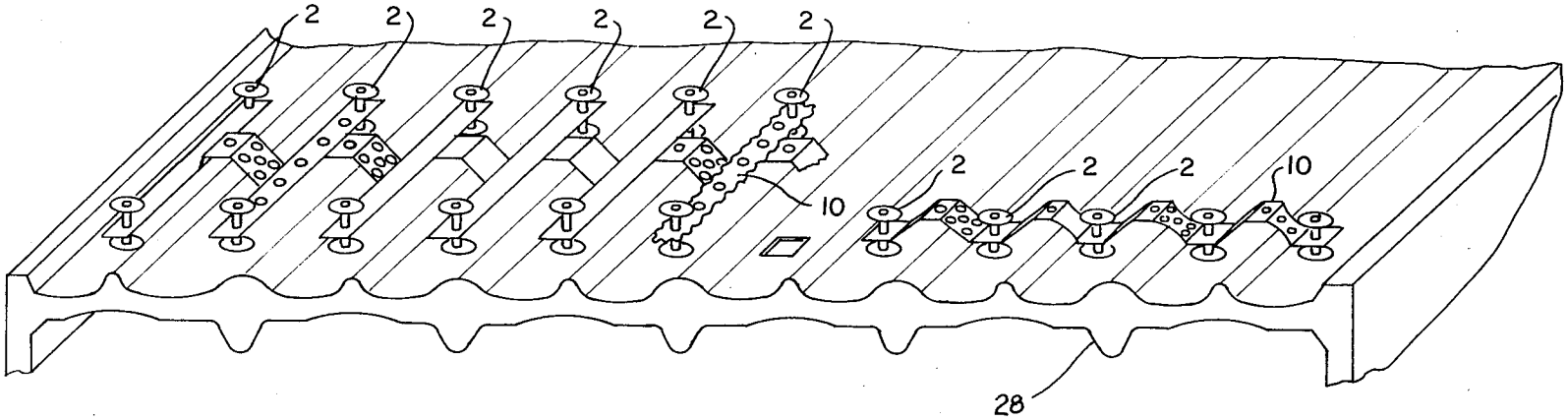
FIG. 5 is a perspective of a casting core showing supporting elements interconnected in accordance with the invention.

With reference to FIG. 1, a plurality of supporting elements 2 are shown. Each supporting element 2 includes an upper support plate 4 and a lower support plate 6. The upper and lower support plates are connected by a separation bar or shank 8. The supporting elements are placed between casting cores as is known in the art to provide separation of the cores. The elements 2 are interconnected by an interconnecting element 10 which is shown in FIG. 1 to be attached to the separation bars 8 approximately midway between upper and lower support plates 4, 6.

FIG. 2 shows a plan view of the structure shown in FIG. 1. In FIG. 2, selected ones of the upper support plates 4 have holes 12 therein for receiving nails to secure the supporting elements to the casting sand in the mold. In a preferred embodiment, the interconnecting element 10 has openings 14 therein, and the edges of these openings are alternatively serrated as illustrated at 16. Also, the outer edges of the interconnecting element 10 may be serrated as illustrated at 18.

FIGS. 3 and 3*a* show embodiments of the invention wherein the interconnecting element 10 has at least two portions which lie in respective, intersecting planes. This embodiment is particularly useful when the casting mold has a surface contour which requires the supporting elements 2 to lie in different planes.

In the embodiment shown in FIG. 3*a*, the interconnecting element 10 is connected to the bottom surfaces of upper support plates 4 instad of the shank 8.

FIG. 3 shows an embodiment similar to that shown in FIG. 3*a*. The interconnecting element 10 is bent to provide the reticulated form shown in the figure, and each corner 20, 22 includes a bead 24 to strengthen the corner bend. Closely spaced supporting elements may use common upper and lower support plates 4' and 6'.

FIG. 4 is a plan view of the embodiment shown in FIG. 3 and shows the interconnecting element 10 in the form of a closed loop having openings 14. Recesses 26 are formed in an edge of the interconnecting element 10.

Figure 6:
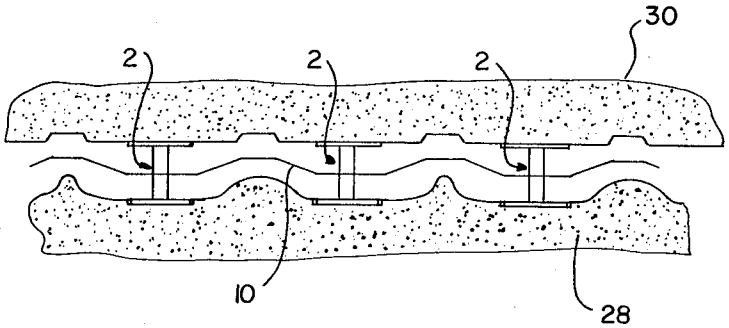
FIG. 6 is a partial end view of upper and lower casting molds.

FIG. 5 is a perspective view a casting mold 28 and shows a preferred manner of placing supporting elements 2 with respect to the mold 28 to provide a separation between lower mold 28 and an upper mold 30 (see FIG. 6). It is clear from FIG. 5 how the interconnecting element 10 greatly simplifies the placement of supporting elements 2. Formerly, it was necessary to secure each individual element to the casting mold. The invention allows the plurality of supporting elements to be easily located to thus reduce cost of manufacturing the element and the installation cost.

FIG. 6 is an end view of lower mold 28 and an upper mold 30 and shows the supporting elements 2 placed between the molds. The interconnecting element 10 preferably follows the contour of the inner surface of the molds so that it is always located between the mold surfaces. It is possible, as shown in FIG. *3a,* for the interconnecting element 10 to be closely spaced from a surface of the mold. The interconnecting element is alternatively a strip, a wire, or a wire mesh.

It will be appreciated that a unique structure has been shown wherein the supporting elements are interconnected to facilitate the placement of a plurality of supporting elements in a casting mold. Modification of the invention within the scope of the appended claims will be apparent to those of skill in the art.

What is claimed is:

1. Aparatus for supporting two casting cores comprising a plurality of supporting elements, each of said supporting elements comprising first and second support plate means for engaging a respective one of said casting cores and separated by separation means, and interconnecting means for interconnecting said plurality of supporting elements, said means for interconnecting being connected to each of said supporting elements, said supporting element and said means for interconnecting being made of a fusible material.

2. Apparatus according to claim 1 wherein a thickness of said means for interconnecting is less than a thickness of either of said first and second support plate means and wherein said interconnecting means is connected to each of said separation means.

3. Apparatus according to claim 2 wherein said means for interconnecting forms a closed loop.

4. Apparatus according to claim 2 wherein said interconnecting means has first and second parts which lie in intersecting planes.

5. Apparatus according to claim 4 wherein said first and second parts are connected by a bent portion of said interconnecting means, and wherein said bent portion includes a reinforcing means.

6. Apparatus according to claim 2 wherein said interconnecting means has openings therein.

7. Apparatus according to claim 6 wherein said openings are formed by serrated edges.

8. Apparatus according to claim 2 wherein at least one of said support plates had holes for receiving nail means for securing said at least one support plate to a casting core.

9. Apparatus according to claim 2 wherein said interconnecting means comprises wire.

10. Apparatus according to claim 1 wherein said interconnecting means is attached to each of said first support plates.

* * * * *